US008556035B1

(12) United States Patent
Kendall et al.

(10) Patent No.: US 8,556,035 B1
(45) Date of Patent: Oct. 15, 2013

(54) LADDER MODULE AND SECUREMENT SYSTEM

(75) Inventors: Larry Kendall, Camdenton, MO (US); Todd Pringnitz, Mount Pleasant, IA (US)

(73) Assignee: Muddy Outdoors, Inc., Camendton, MO (US)

( * ) Notice: Subject to any disclaimer, the term of this patent is extended or adjusted under 35 U.S.C. 154(b) by 0 days.

(21) Appl. No.: 13/442,470

(22) Filed: Apr. 9, 2012

Related U.S. Application Data

(63) Continuation of application No. 12/683,978, filed on Jan. 7, 2010, now abandoned.

(60) Provisional application No. 61/143,063, filed on Jan. 7, 2009, provisional application No. 61/148,734, filed on Jan. 30, 2009.

(51) Int. Cl.
*E06C 1/00* (2006.01)

(52) U.S. Cl.
USPC ..... 182/156; 182/187; 182/189

(58) Field of Classification Search
USPC ..... 182/187, 100, 116, 189
See application file for complete search history.

(56) References Cited

U.S. PATENT DOCUMENTS

| | | | | | |
|---|---|---|---|---|---|
| 315,025 | A * | 4/1885 | Heath | 182/135 |
| 493,391 | A * | 3/1893 | Sturtevant | 182/135 |
| 646,291 | A * | 3/1900 | Kroeger | 182/156 |
| 696,711 | A * | 4/1902 | Briner | 182/100 |
| 3,019,851 | A * | 2/1962 | Doss | 182/111 |
| 4,132,288 | A * | 1/1979 | Bingham | 182/156 |
| 4,432,436 | A * | 2/1984 | Suiter | 182/97 |
| 4,928,791 | A * | 5/1990 | Hong | 182/135 |
| 5,752,580 | A * | 5/1998 | Jenkins, Jr. | 182/100 |
| 5,806,626 | A * | 9/1998 | Jenkins, Jr. | 182/100 |
| 5,816,362 | A * | 10/1998 | Jenkins, Jr. | 182/100 |
| 6,547,035 | B1 * | 4/2003 | D'Acquisto | 182/100 |
| 6,782,840 | B1 * | 8/2004 | Garelick et al. | 114/362 |
| 7,163,082 | B2 * | 1/2007 | Bigard | 182/100 |
| 8,006,803 | B2 * | 8/2011 | Guering | 182/100 |
| 2007/0151803 | A1 * | 7/2007 | D'Acquisto | 182/187 |

* cited by examiner

*Primary Examiner* — Alvin Chin Shue
*Assistant Examiner* — Candace L Bradford
(74) *Attorney, Agent, or Firm* — Hamilton IP Law, PC; Jay R. Hamilton; Charles A. Damschen

(57) ABSTRACT

The various embodiments disclosed and pictured illustrate a ladder module for use in ascending or descending generally cylindrical, vertically oriented structures and a securement system for positioning various objects on a generally cylindrical, vertically oriented structure. One embodiment of the ladder module comprises a spine and at least two steps pivotally mounted to the spine. A step mounting bracket base may be affixed to a step mounting bracket bolt, and each step may in turn be pivotally mounted to the step mounting bracket base. The step mounting bracket base and the tree bracket may be secured to the spine with the step mounting bracket bolt. The ladder module may be mounted to a tree or similar structure using a flexible member such as a rope, wherein one end of the flexible member is secured to the spine and the flexible member is engageable with the securement structure.

17 Claims, 11 Drawing Sheets

LADDER MODULE AND SECUREMENT SYSTEM

CROSS REFERENCE TO RELATED APPLICATIONS

This application is a continuation of and claims priority from U.S. patent application Ser. No. 12/683,978 filed on Jan. 7, 2010 now abandoned, which application claimed the filing benefit under 35 U.S.C. §119(e) of provisional U.S. Pat. App. Nos. 61/143,063 filed on Jan. 7, 2009 and 61/148,734 filed on Jan. 30, 2009, all of which applications are incorporated by reference herein in their entireties.

FIELD OF INVENTION

This invention relates generally to a ladder module and a device for securing items to generally vertically oriented, generally cylindrically shaped structures. More specifically, the invention is especially useful for climbing trees and securing items to a tree.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

BACKGROUND

In order to hunt or observe wild game, many individuals find it desirable to place themselves in an elevated position above the animal hunted to prevent the animal from detecting the individual. To do so, many individuals use tree stands that position the hunter in a tree above ground level, keeping the hunter out of the typical line of sight of the animal.

As these tree stands are designed to position the individual in a tree above ground level, many times the individual will use a ladder both to position the tree stand within the tree and for accessing the tree stand once it is in place. To accommodate the needs of the individual utilizing the ladder, the ladders designed for this purpose should optimally be lightweight, stable, durable, and easily portable.

The simplest type of ladder that may be used for this purpose is a conventional stepladder, consisting of a pair of parallel rails separated by a number of steps or rungs attached between the rails. An individual may lean the stepladder against tree or adjacent structure to allow the in to secure the tree stand at the desired level on the tree. However, conventional stepladders present certain problems when used for this purpose. Due to the size of most stepladders, they become unwieldy when transported into the normally confined environment of a forest where a tree stand is used. Also, the stepladder is not equipped with any type of safety device that reliably secures the stepladder to the tree. Without such a device, there is no way to prevent the ladder from inadvertently sliding off of the tree and injuring an individual using the ladder.

Other types of ladders have been specially designed for use in connection with tree stands to overcome the problems associated with utilizing a conventional ladder. One type of ladder designed specifically for this purpose is disclosed in U.S. Pat. No. 3,336,999 issued to McSwain. This combination ladder and tree stand includes a stand or platform upon which the user may sit, a ladder assembly extending downwardly from one side of the stand to support the stand above the ground, and a clamp mechanism attached beneath the stand opposite ladder assembly for securing the stand and ladder assembly to the trunk of a tree. The ladder assembly is comprised of a number of intermediate ladder sections that are detachable from one another, allowing the ladder assembly to be quickly disassembled and placed into a compact, portable arrangement.

While this teaching provides a ladder and tree stand capable of being reliably secured to a tree trunk by the clamp mechanism, the ladder assembly forms a conventional stepladder-type arrangement when assembled. As such, the tree stand still has disadvantages similar to those associated with a conventional stepladder. For instance, the clamping mechanism will only properly grip the tree when the ladder assembly is placed at an angle commensurate with the tree trunk. When an irregularly shaped tree trunk is not substantially perpendicular to the ground at the point at which the clamping mechanism is attached to the tree, the ladder assembly is not able to be positioned perpendicularly to the ground to insure a stable base for the ladder assembly. Therefore, the assembly cannot be utilized with a tree having an irregularly shaped trunk. This necessarily limits the number of trees on which the tree stand disclosed in McSwain may be used. Furthermore, as the ladder assembly is a single, unitary piece when constructed, any limbs or branches extending outwardly from the lower portion of the trunk may also create problems by contacting the assembly and preventing the proper stable positioning of the assembly adjacent the selected tree.

Other types of ladders have been developed for climbing trees that utilize a modular construction that allows the ladders to be utilized with trees having irregularly shaped trunks and/or branches extending from the trunk at a low level, conditions which make ladders having conventional stepladder arrangement unusable.

The individual modules, or climbing sticks, used in forming these ladders have a simple construction comprised of a number of individual alternating steps secured to an elongate tubular support member. One such ladder module is disclosed in U.S. Pat. No. 6,547,035 issued to D'Acquisto, which is incorporated by reference herein in its entirety.

Each module is secured to the tree trunk by engaging a securing belt, which is removably attached to one side of the support member, with a buckle strap, which is also removably attached to one side of the support member. The securing belt and buckle strap are releasably engaged with one another through a buckle.

The module is supported on the tree by stabilizing brackets located at various positions along the length of the support member. The brackets engage the trunk of the tree to prevent the ladder module from sliding downwardly along the trunk while supporting a hunter. The brackets are rotatably mounted to each end of the support member to allow each bracket to independently conform to the direction in which the tree trunk extends.

However, these individual ladder modules disclosed in D'Acquisto have shortcomings. First, each step is mounted on only one side of the support member. Therefore, if a user steps to the wrong side, there will be no step to support the user, which increases the potential for injury. Furthermore, these types of ladder modules use conventional buckles or clips to secure the strap around the tree. These buckles or clips may allow the strap to loosen over time or with repeated use, which also increases the potential for injury.

BRIEF DESCRIPTION OF THE FIGURES

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limited of its scope, the invention will be described and explained with additional specificity and detail through the use of the accompanying drawings.

DETAILED DESCRIPTION

Listing of Elements

DETAILED DESCRIPTION - LISTING OF ELEMENTS

Figure 1:
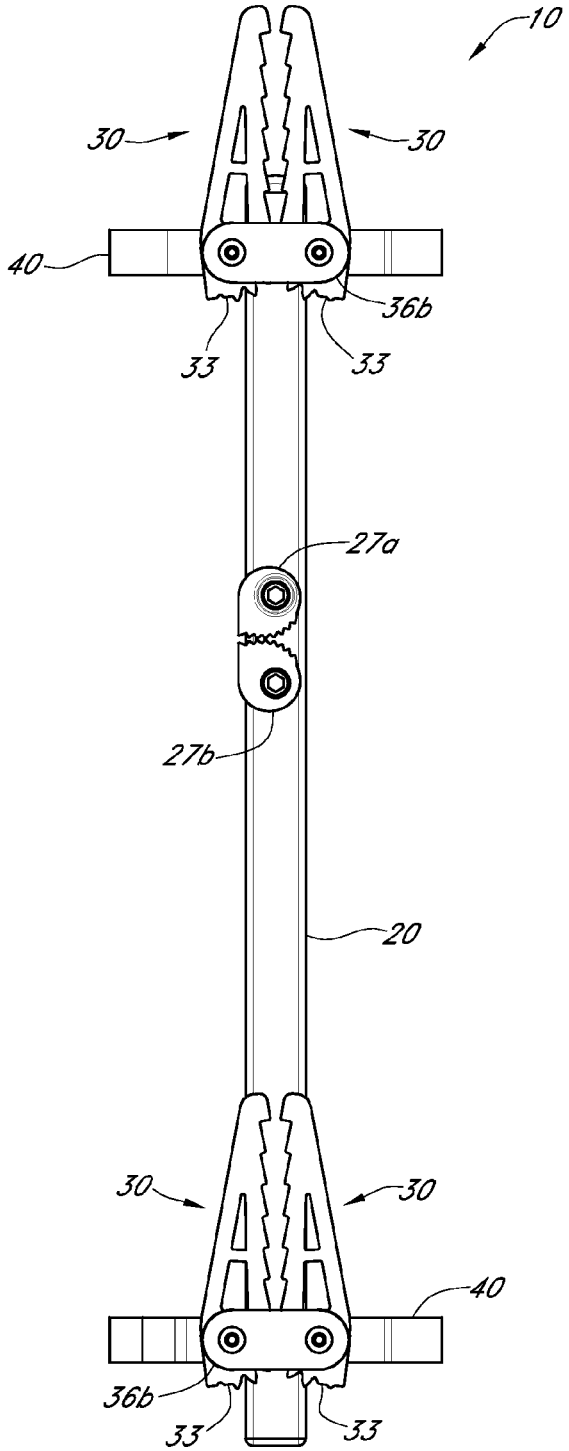
FIG. 1 provides a front view of one embodiment of the ladder module with the steps in the folded position.

| ELEMENT DESCRIPTION | ELEMENT # |
|---|---|
| Ladder module | 10 |
| Tree | 12 |
| Flexible member | 14 |
| Flexible member loose end | 15 |
| Ladder module pack | 18 |
| Spine | 20 |
| Step mounting bracket pocket | 22 |
| Knot | 24 |
| Knot pocket | 26 |
| Top cam | 27a |
| Bottom cam | 27b |

-continued

DETAILED DESCRIPTION - LISTING OF ELEMENTS

| ELEMENT DESCRIPTION | ELEMENT # |
|---|---|
| Cam bolt | 28 |
| Cleat | 29 |
| Step | 30 |
| Step gear | 31 |
| Step tread | 32 |
| Step limit | 33 |
| Aperture | 34 |
| Bolt | 35 |
| Step mounting bracket base | 36a |
| Step mounting bracket top | 36b |
| Step mounting bracket bolt | 37 |
| Washer | 38 |
| Nut | 39 |
| Tree bracket | 40 |
| Spine pocket | 42 |
| Tree engagement member | 44 |
| Camera arm | 50 |
| Camera arm base | 52 |
| Tree stand | 60 |

DETAILED DESCRIPTION

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

Referring now to the drawings, wherein like reference numerals designate identical or corresponding parts throughout the several views, FIG. 1 provides a front view of a first embodiment of the ladder module 10 configured with the present securement system. As is well known to those skilled in the art, several ladder modules 10 may be used in conjunction with one another depending on the height to which the user desires to reach. As shown in the various figures herein, each ladder module 10 in the embodiment pictured herein includes four steps 30 arranged in two pairs—a lower pair and an upper pair. However, in other embodiments not pictured herein, the ladder module 10 may have a different number of steps 30, as long as the steps 30 are arranged in pairs of two, without departing from the spirit and scope of the ladder module 10. For example, in an embodiment not pictured herein, the ladder module is formed with six steps 30 arranged in pairs of two.

Figure 7:
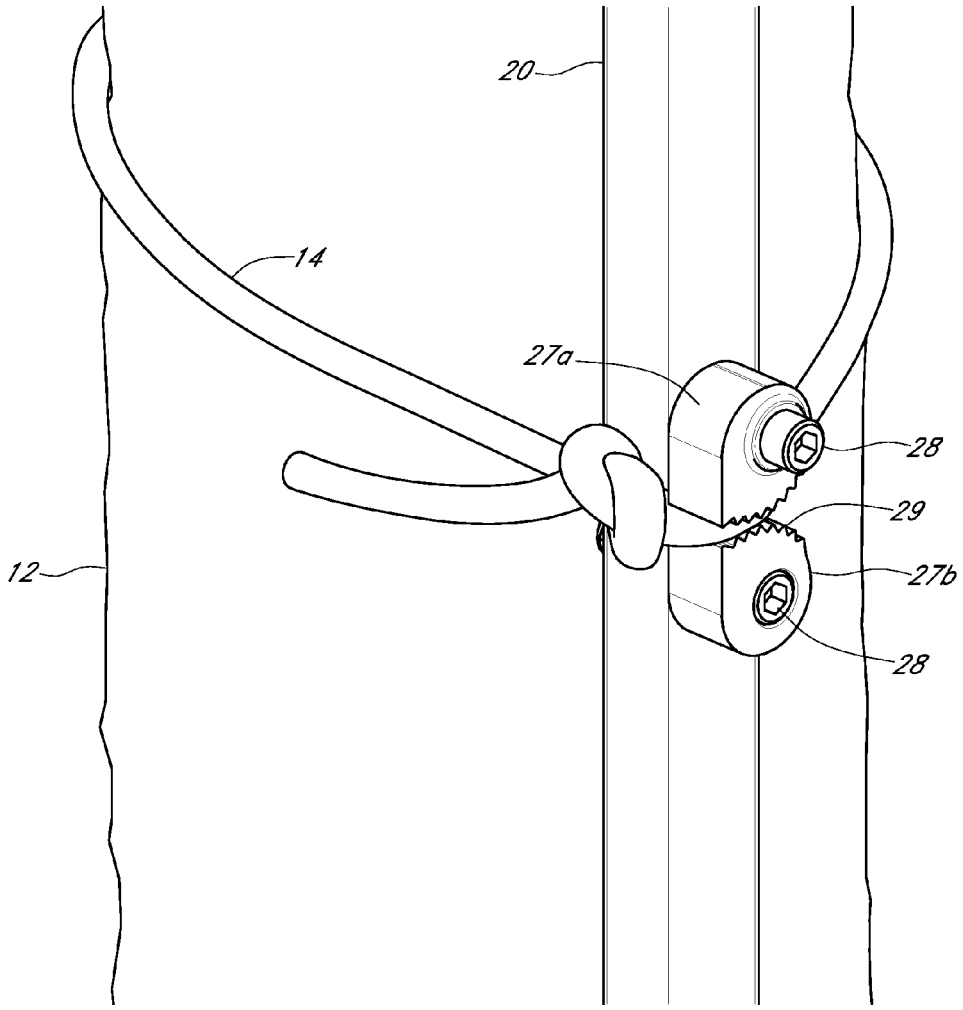
FIG. 7 provides a detailed perspective view of a pair of cooperating cams engaging a rope with one embodiment of the ladder module engaged with a tree.
Figure 8:
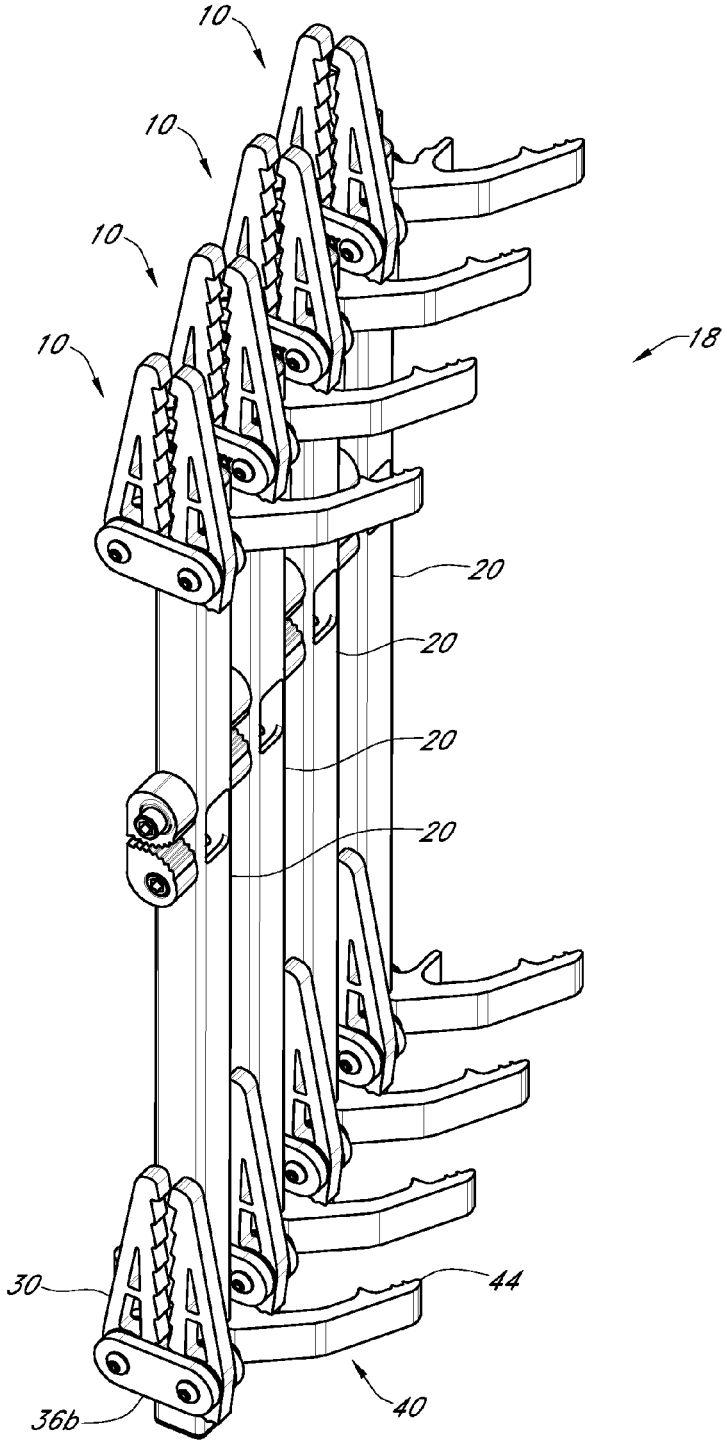
FIG. 8 provides a perspective view of four ladder modules of one embodiment nested with one another and the steps from each ladder module in the folded position.
Figure 9:
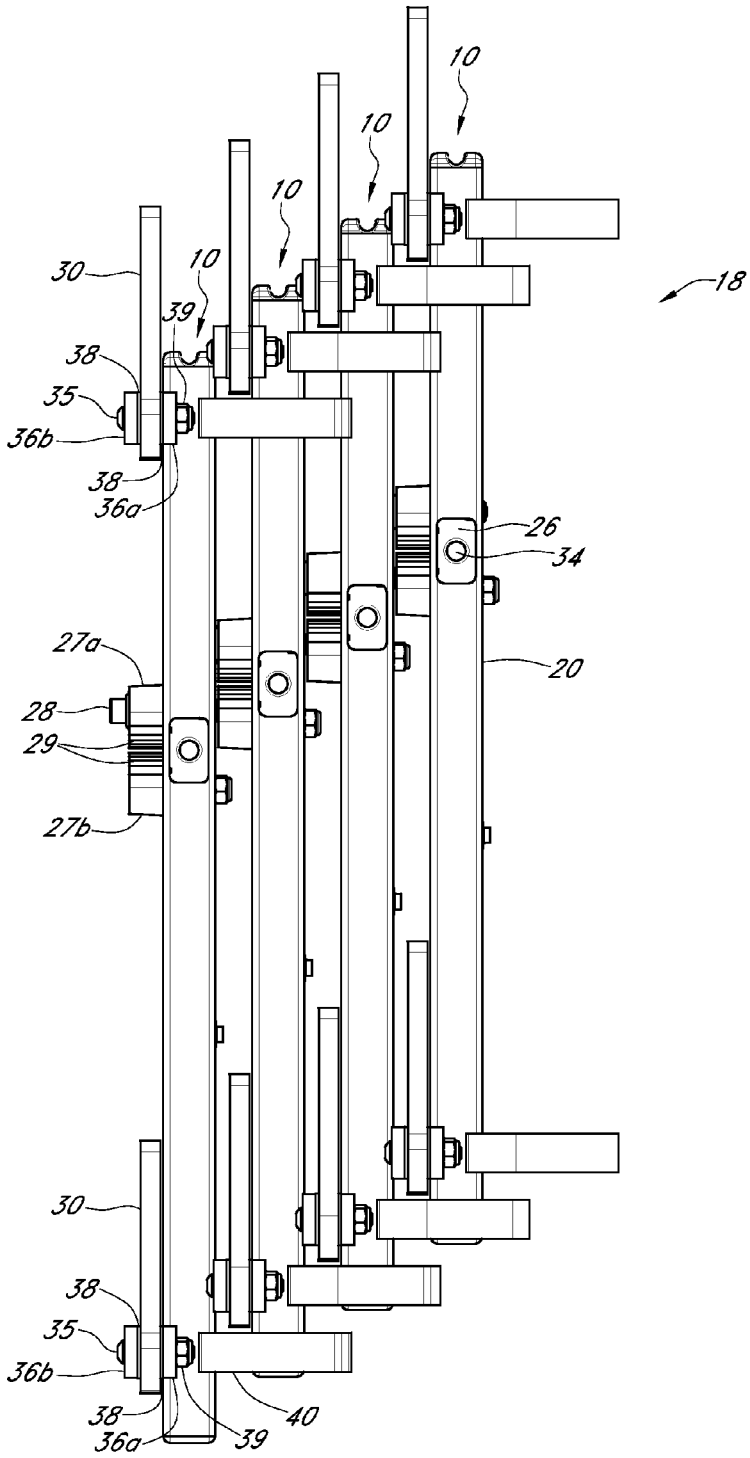
FIG. 9 provides a side view of four ladder modules of one embodiment nested with one another and the steps from each ladder module in the folded position.

In FIG. 1, the steps 30 are shown in the folded position. In this position, the ladder module 10 is more compact and easy to transport. When the steps 30 are in the folded position, multiple ladder modules 10 may be placed adjacent one another in a nested arrangement to form a ladder module pack 18 while occupying a minimal volume. FIG. 7 provides a perspective view of four ladder modules 10 of the first embodiment nested together to form a ladder module pack 18, while FIG. 8 provides a side view of the same ladder module pack 18. Accordingly, any number of ladder modules 10 may be nested and/or packaged with one another in a minimal volume of space to make a ladder module pack 18.

Figure 2:
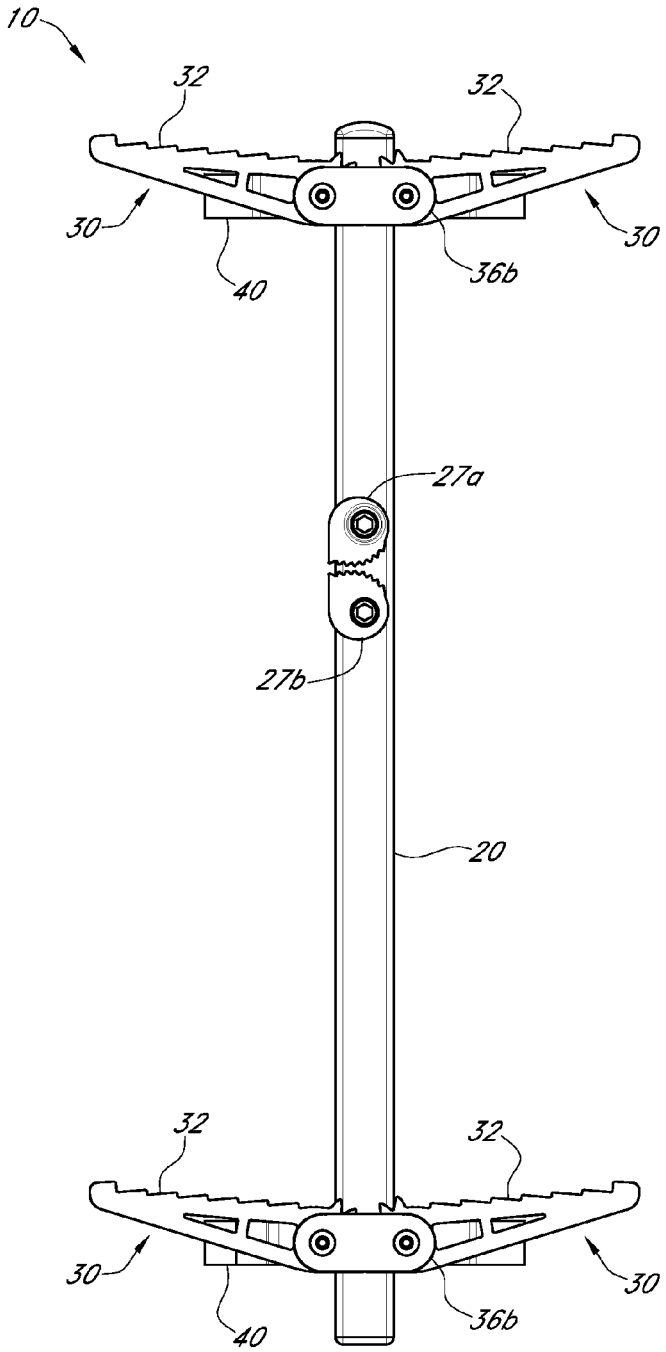
FIG. 2 provides a front view of one embodiment of the ladder module with the steps in the extended position.

As shown in FIG. 2, the steps 30 are in the extended position. In this position, the steps 30 may be engaged by a user when the ladder module 10 is in use. Multiple ladder modules 10 may be nested with the steps 30 in the extended position, however, the overall width of each ladder module 10 is greater with the steps 30 in the extended position than with the steps 30 in the folded position. Consequently, multiple ladder modules 10 nested with one another with the steps 30 in the folded position are more easily transported than if the steps 30 were in the extended position.

Figure 3:
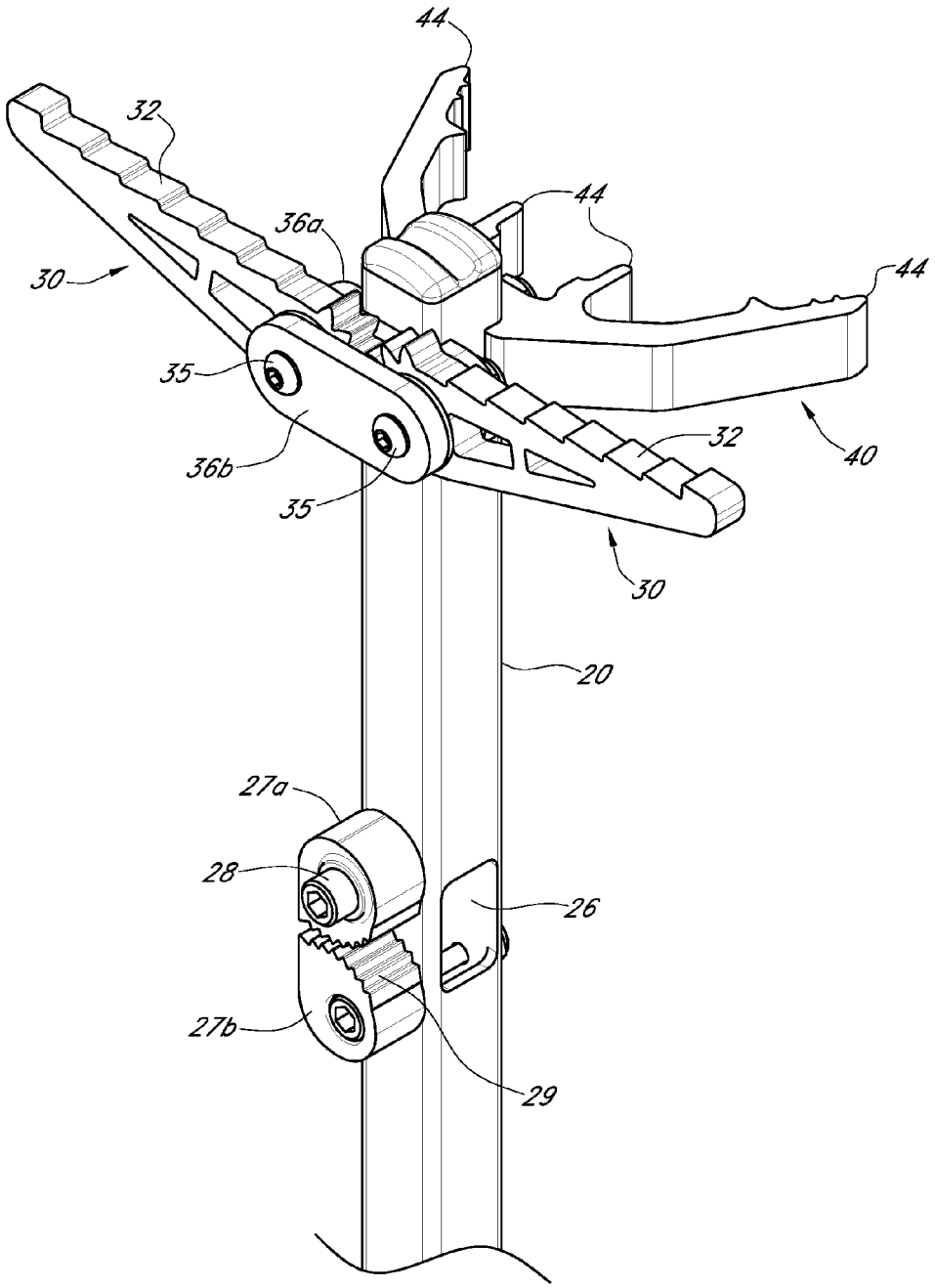
FIG. 3 provides a detailed perspective view of a pair of steps in the extended position, the adjacent tree bracket, and the mounting components for use therewith in one embodiment.

A detailed perspective view of two steps 30, a tree bracket 40, and the associated mounting components for the first embodiment is shown in FIG. 3. In the first embodiment, the spine 20 serves as the main structural component for the ladder module 10. The steps 30 are pivotally connected to the spine 20 with the associated mounting components, which is best shown in the exploded view of FIG. 4.

Figure 4:
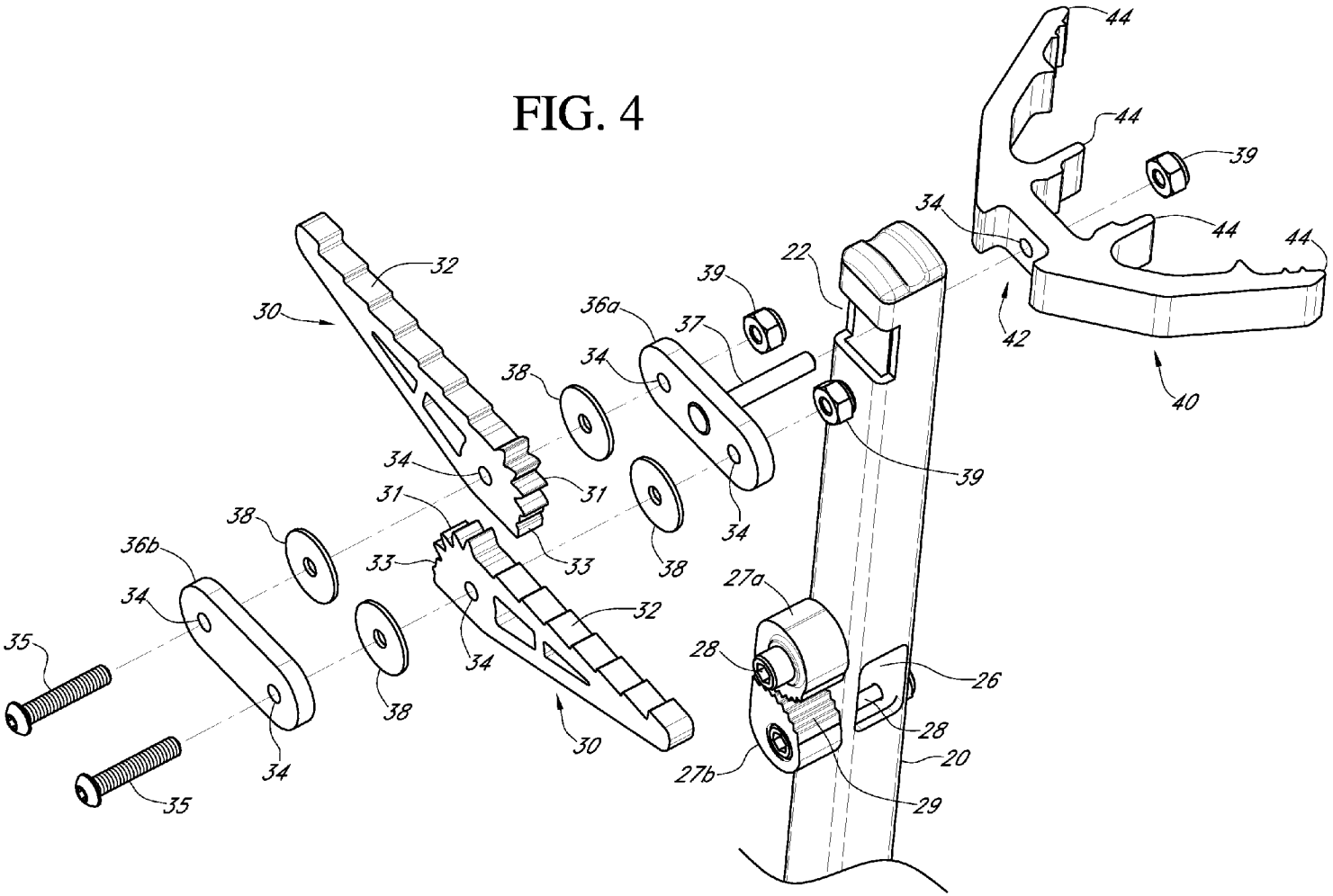
FIG. 4 provides an exploded view of a pair of steps, the adjacent tree bracket, and the mounting components for use therewith in one embodiment.

Referring now to FIG. 4, the spine 20 in the embodiment of the ladder module 10 pictured herein is formed with a step mounting bracket pocket 22 therein. A step mounting bracket base 36*a*, which may be affixed to a step mounting bracket bolt 37, seats within the step mounting bracket pocket 22 in the spine 20. The step mounting bracket bolt 37 passes through an aperture 34 formed in the spine 20, which aperture 34 is oriented substantially in the center of the step mounting bracket pocket 22 in the embodiment pictured herein. The step mounting bracket base 36*a* may be fashioned with two apertures 34 oriented substantially symmetrical with respect to the step mounting bracket bolt 37. The apertures 34 in the step mounting bracket base 36*a* correspond to apertures 34 formed in each step 30 and to apertures 34 formed in the step mounting bracket top 36*b*. Other structures and/or methods for securing the step mounting bracket base 36*a* and/or or tree bracket 40 (described in detail below) to the spine 20 may be used in other embodiments of the ladder module 10 not pictured herein without departing from the spirit and scope of the ladder module 10. For example, a rivet, screw and cap, or any other structure known to those skilled in the art may be used to secure the step mounting bracket base 36*a* and/or tree bracket 40 to the spine 20.

A bolt 35 and corresponding nut 39 may be used to pivotally secure each step 30 between the step mounting bracket base 36*a* and step mounting bracket top 36*b*. In the first embodiment, two bolts 35 and nuts 39 are used to pivotally secure each pair of steps 30 to the step mounting bracket base 36*a* and step mounting bracket top 36*b*. The nuts 39 used in the embodiment pictured herein are lock nuts, but other types of nuts 39 may also be used. In other embodiments not pictured herein, other numbers of bolts 35 and nuts 39 may be used, or components other than bolts 35 and nuts 39 suitable for the particular application of the ladder module 10 may be used without departing from the spirit and scope of the ladder module 10. For example, each step 30 may be pivotally mounted to the spine 20 and/or step mounting bracket base 36*a* using rivets and washers, lag screws, or any other structure and/or method known to those skilled in the art. Accordingly, any connection mechanism known to those skilled in the art may be used without departing from the spirit and scope of the ladder module 10.

Washers 38 may be placed on each bolt 35 between the step mounting bracket base 36*a* and step 30 and/or between the step mounting bracket top 36*b* and step 30 to increase ease of use and longevity of the ladder module 10. If used, the washers 38 may be constructed of any material known to those skilled in the art that is suitable for the specific application, such as metal, metal alloys, cellulosic material, Teflon® or other polymers, or any combination thereof.

Each step 30 may be pivotally mounted to the step mounting bracket base 36*a* and step mounting bracket top 36*b* such that each step 30 may be rotated by a predetermined amount with respect to the spine 20. Each step 30 may be formed with a step gear 31 adjacent the aperture 34 through which the bolt 35 passes. The top side of each step 30 is formed as a step tread 32, which provides a surface for the user to engage when the ladder module 10 is in use. In the folded position, as shown in FIG. 1, the step treads 32 of two steps 30 of a pair are facing one another.

As shown in the figures herein, the step tread 32 is configured to provide the user with sufficient traction even in inclement conditions. The step tread 32 may be configured in other manners without departing from the spirit and scope of the ladder module 10, and therefore is in no way limiting to the scope of the ladder module 10.

Figure 5:
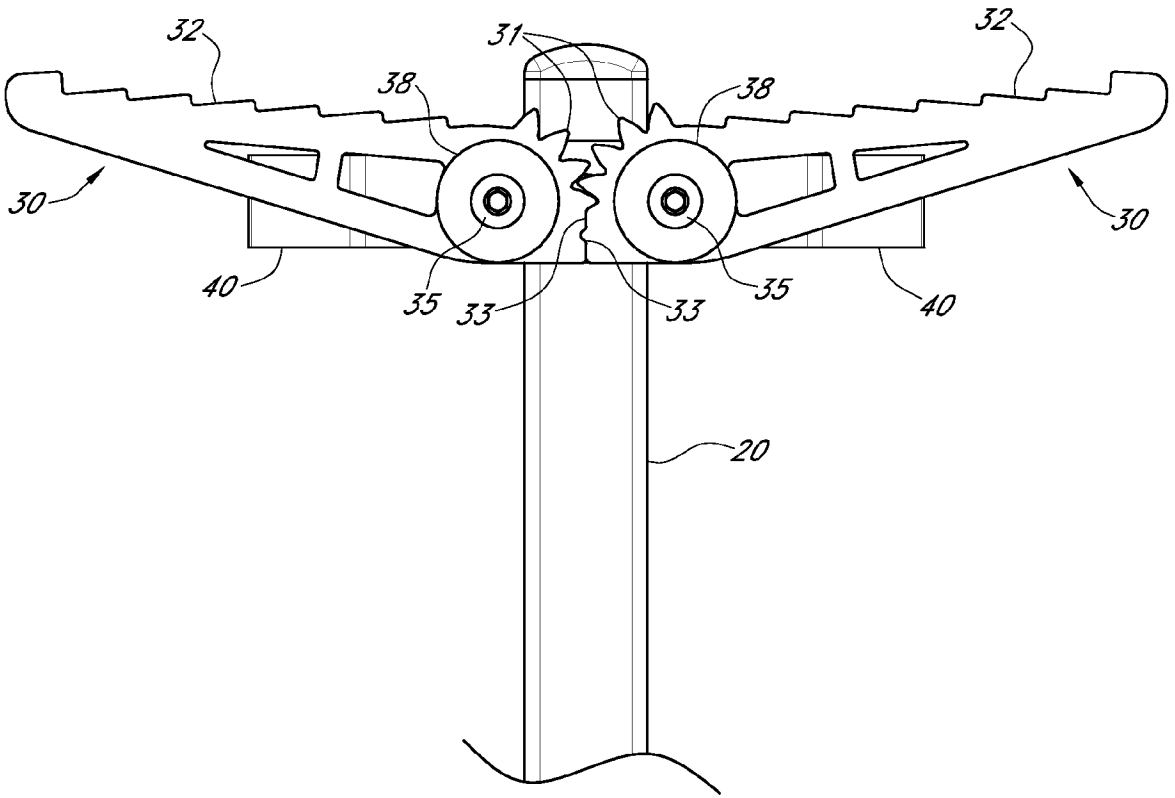
FIG. 5 provides a detailed view of a pair of steps from one embodiment in the extended position with the step mounting bracket top removed for clarity.

In the first embodiment, the step gear 31 from one step 30 of a pair of steps 30 intermeshes with the step gear 31 on the other step 30 of the pair, which two steps 30 are adjacent one another (as shown in FIG. 5 with the step mounting bracket top 36*b* removed). Accordingly, when one step 30 of a pair is rotated, the other step 30 of the pair rotates in an opposite rotational direction by the same radial amount. That is, if a user rotates the left step 30 as shown in FIG. 5 clockwise by thirty degrees, the step gears 31 of the two steps 30 will cause the right step 30 to rotate thirty degrees in the counter-clockwise direction. This configuration of steps 30 and step gears 31 allows the user to easily manipulate the steps 30 on the ladder module 10 to change from the folded position to the extended position and vice versa.

Each step 30 is also fashioned with a step limit 33 in the first embodiment. The step limit 33 is positioned adjacent the step gear 31, and the step limit 33 from one step 30 of a pair engages the step limit 33 on the other step 30 of the pair when the two steps 30 are in the extended position. The step limit 33 serves to limit the amount of rotation the steps 30 may undergo to reach the extended position and also serve to define the extended position.

When two steps 30 of a pair are moved from the folded to the extended position, the step gears 31 engage one another as explained above. When the step limits 33 on two steps 30 of a pair engage one another, as best shown in FIG. 5, both steps 30 of the pair are in the fully extended position and are not allowed to rotate in that direction any further. That is, as shown in FIG. 5, the left step 30 may not rotate in the counter-clockwise direction any further, and the right step 30 may not rotate in the clockwise direction any further due to the engagement of the step limits 33 between the two steps 30.

This configuration of steps 30 in the extended position (i.e., the position in which the steps 30 will bear the weight of a user), wherein the step limits 33 of adjacent steps 30 engage one another, leads to increased capacity of the steps 30 through force distribution. Because the step limit 33 from one step 30 is engaged with the step limit 33 on the adjacent step 30 of a pair when the steps 30 are in the extended position, when the user applies a force to one step 30, a portion of that force is transferred to the other step 30 of the pair. Accordingly, a force placed on one step 30 is distributed to two bolts 35 (i.e., each bolt 35 passing through the aperture 34 of each step 30 of the pair), to both sides of the step mounting bracket base and top 36*a*, 36*b*, and results in a shear force on the two bolts 35 rather than a leveraging force on the step 30 to which the force is applied. This configuration also results in a more stable and balanced system under circumstances in which one step 30 of a pair experiences a force greater or less than the other step 30 of the pair. Furthermore, because the step mounting bracket base 36*a* is positioned in the step mounting bracket pocket 22 formed in the spine 20, any force placed on any step 30 is ultimately transferred to the spine 20 at the step mounting bracket pocket 22. This method of mounting the steps 30 to the spine 20 eliminates welds and ensures that forces applied to the steps 30 will not be borne by a single bolt 35 or combination of bolts 35 in a leveraging manner. Instead, the force is distributed about several elements in a variety of manners, including leveraging and shearing, to ensure a more robust, stable, and well-balanced system.

Also affixed to the spine 20 is at least one tree bracket 40. The tree bracket 40 may be configured in many different arrangements depending on the specific application for the ladder module 10 without departing from the spirit and scope of the ladder module 10. In the first embodiment, the tree bracket 40 is fashioned with a spine pocket 42 in the center thereof and four main tree engagement members 44. In other embodiments not pictured herein, the tree bracket 40 includes fewer tree engagement members 44, and in still other embodiments the tree bracket 40 includes a greater number of tree engagement members 44 than in the first embodiment. The tree engagement members 44 serve to contact the surface of the object to which the ladder module 10 is mounted, which is typically a tree 12 or similar generally vertically oriented, cylindrically shaped stricture.

The tree bracket 40 may be fashioned with an aperture 34 passing therethrough, wherein the aperture 34 is centered in the spine pocket 42. In other embodiments, the aperture 34 in the tree bracket 40 is in a different location than the center of the spine pocket 42 as depicted in the first embodiment. In the first embodiment, the tree bracket 40 is affixed to the spine 20 with the step mounting bracket bolt 37. The step mounting bracket bolt 37 passes through the aperture 34 formed in the tree bracket 40 and a nut 39 then may be placed on the end of the step mounting bracket bolt 37 to secure the tree bracket 40 to the spine 20. As with the nuts 39 engaging the bolts 35 passing through the steps 30, the nut 39 engaging the step mounting bracket bolt 37 is a lock nut. In other embodiments not pictured herein, components other than a step mounting bracket bolt 37 and corresponding nut 39 may be used to secure the tree bracket 40 to the spine 20, such as rivets, pins, or any other structure known to those skilled in the art. Accordingly, any suitable connection structures appropriate for the particular application of the ladder module 10 may be used without departing from the spirit and scope of the ladder module 10 and securement system.

The spine pocket 42, which is a recessed portion fashioned in the area of the tree bracket 40 that engages the spine 20, ensures that the tree bracket 40 cannot rotate with respect to the spine 20 when the nut 39 is tightened on the step mounting bracket bolt 37. As shown in the first embodiment, each ladder module 10 includes two tree brackets 40, wherein each tree bracket 40 is positioned along the spine 20 at the same location as each pair of steps 30. However, in other embodiments not pictured herein, the ladder module 10 may have more tree brackets 40 than pairs of steps 30 or fewer tree brackets 40 than pairs of steps 30, and the tree brackets 40 may be positioned along the spine 20 at different intervals than the pairs of steps 30 without departing from the spirit and scope of the ladder module 10.

Figure 6:
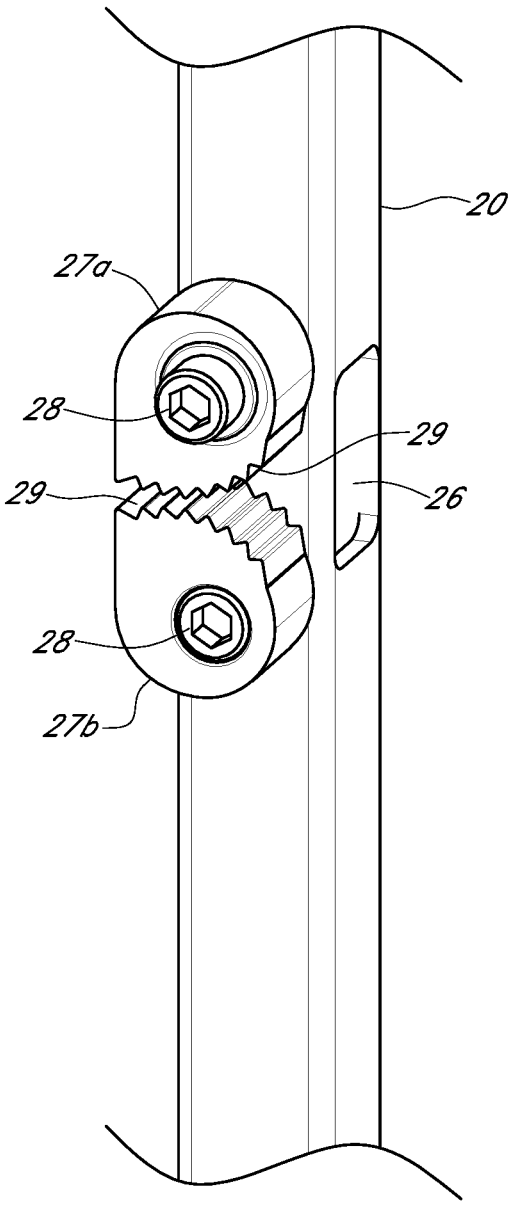
FIG. 6 provides a detailed perspective view of a pair of cooperating cams and a knot pocket in the spine in one embodiment.

Pivotally attached to the spine 20 are a top cam 27*a* and a bottom cam 27*b* in one embodiment, which is best shown in FIG. 6. Each cam 27*a*, 27*b* is formed with a plurality of cleats 29 therein and attached to the spine 20 with a separate cam bolt 28. Other components may be used to pivotally attach the cams 27*a*, 27*b* to the spine 20, such as pins, rivets, or other components known to those skilled in the art. Accordingly, any suitable means for attaching the cams 27*a*, 27*b* to the spine 20 may be used without departing from the spirit and scope of the ladder module 10 and securement system as disclosed and claimed herein.

The cleats 29 on corresponding cams 27*a*, 27*b* face each other, and the cams 27*a*, 27*b* may be biased about an axis of rotation so that the cleats 29 are urged together. For example, in one embodiment a coil spring (not shown) may be positioned concentrically with the cam bolt 28 and longitudinal axis of a cam 27*a*, 27*b* such that the coil spring is affixed to both the cam bolt 28 and interior of the cam 27*a*, 27*b* adjacent that cam bolt 28 such that the coil spring imparts a rotational force to the adjacent cam 27*a*, 27*b* with respect to the cam bolt 28.

As shown in FIG. 6, the cams 27*a*, 27*b* are shaped such that as the top cam 27*a* is rotated in the counterclockwise direction, the distance between the periphery of cams 27*a*, 27*b* adjacent the cleats 29 decreases and vice versa. Correspondingly, as the bottom cam 27*b* is rotated in the clockwise direction, that distance also decreases. As the bottom cam 27*b* is rotated in the counterclockwise direction that distance increases. Any configuration/orientation of the cams 27*a*, 27*b*, cleats 29, or axes of rotation of the cams 27*a*, 27*b* that achieves such functionality may be used with the ladder module 10 or securement system without limitation. Furthermore, in certain embodiments one of the cams 27*a*, 27*b* may be fixedly mounted, while the corresponding cam 27*a*, 27*b* may be pivotally mounted.

In other embodiments not pictured herein, cleats 29 are not formed into the cams 27*a*, 27*b*, and instead the cams 27*a*, 27*b* are formed with alternative patterns or non-slip materials. Accordingly, any configuration of the opposing faces of the cams 27*a*, 27*b* or material thereon that prevents a rope or other securing member (which may be a flexible member 14) from passing between the cams 27*a*, 27*b* in at least one direction may be used without limiting the scope of the ladder module 10 and securement system.

In the embodiment of the ladder module pictured herein, the cams 27*a*, 27*b* are one type of securement structure, which securement structure may cooperate with a flexible member 14 to form a securement system. Any suitable securement structure known to those skilled in the art may be used with the ladder module 10 without departing from the spirit and scope thereof, including but not limited to clamps, binders, clips, and/or combinations thereof. Furthermore, biasing members other than the coil spring type described above may be used with the cams 27*a*, 27*b* such as biasing mechanisms incorporated into the cam bolts 28. The specific shape of the cams 27*a*, 27*b*, biasing mechanism, and orientation and number of cleats 29 on each cam 27*a*, 27*b* is in no way limiting to the scope of the ladder module 10 and securement system.

The ladder module 10 is shown engaged with a tree 12 in FIG. 7. As shown in FIG. 7, a flexible member 14 (which is shown as a rope in the figures herein but may be any suitable flexible member 14 known to those skilled in the art) may be used to secure the ladder module 10 to a tree 12 or other generally cylindrically shaped, vertically oriented structure. Any flexible structure, such as cable (not shown), chain (not shown), etc. known to those skilled in the art may be used without limiting the scope of the ladder module 10 and securement system.

A knot pocket 26 and an adjacent aperture 34 may be fashioned in the spine 20, which is best shown in FIG. 6. One end of the flexible member 14 is then passed through the aperture 34 and a knot 24 is formed in that end of the flexible member 14. The knot 24 fits within the knot pocket 26 to protect the knot 24 and reduce obstructions on the exterior of the spine 20. The flexible member loose end 15 may then be placed around the periphery of the tree 12 or other structure upon which the ladder module 10 is mounted. The flexible member loose end 15 is positioned between a top cam 27*a* and a bottom cam 27*b* and pulled tight around the tree 12. The cams 27*a*, 27*b* are configured such that the flexible member 14 may slide between the cleats 29 in only the direction that will cause the flexible member 14 to tighten around the tree 14. That is, when the flexible member 14 is pulled in such a way as to loosen the flexible member 14 from the periphery of the tree 14, the clearance between the cleats 29 decreases and the cams 27*a*, 27*b* pinch the flexible member 14 with increasing force so that the flexible member 14 will not slide past the cleats 29 in that direction. The tightening action of the cams 27*a*, 27*b* may be further accentuated if the cams 27*a*, 27*b* include a biasing mechanism as described above. The flexible member loose end 15 may subsequently be tied in a knot 24 after it is positioned between the cams 27*a*, 27*b* to reduce the possible obstructions on the exterior of the ladder module 10, which is shown in FIG. 7.

To remove the flexible member 14 from the cams 27*a*, 27*b*, the user may simply pull the flexible member 14 away from the cams 27*a*, 27*b* in a lateral direction so that the cleats 29 slide past the surface of the flexible member 14. However, if a different flexible member (such as a strap, cable, etc.) or a different securement structure affixed to the ladder module 10 (such as a binder, clamp, etc.) is used in conjunction with the ladder module 10, a different method for engaging and/or releasing the flexible member from the securement structure may be required.

Figure 10:
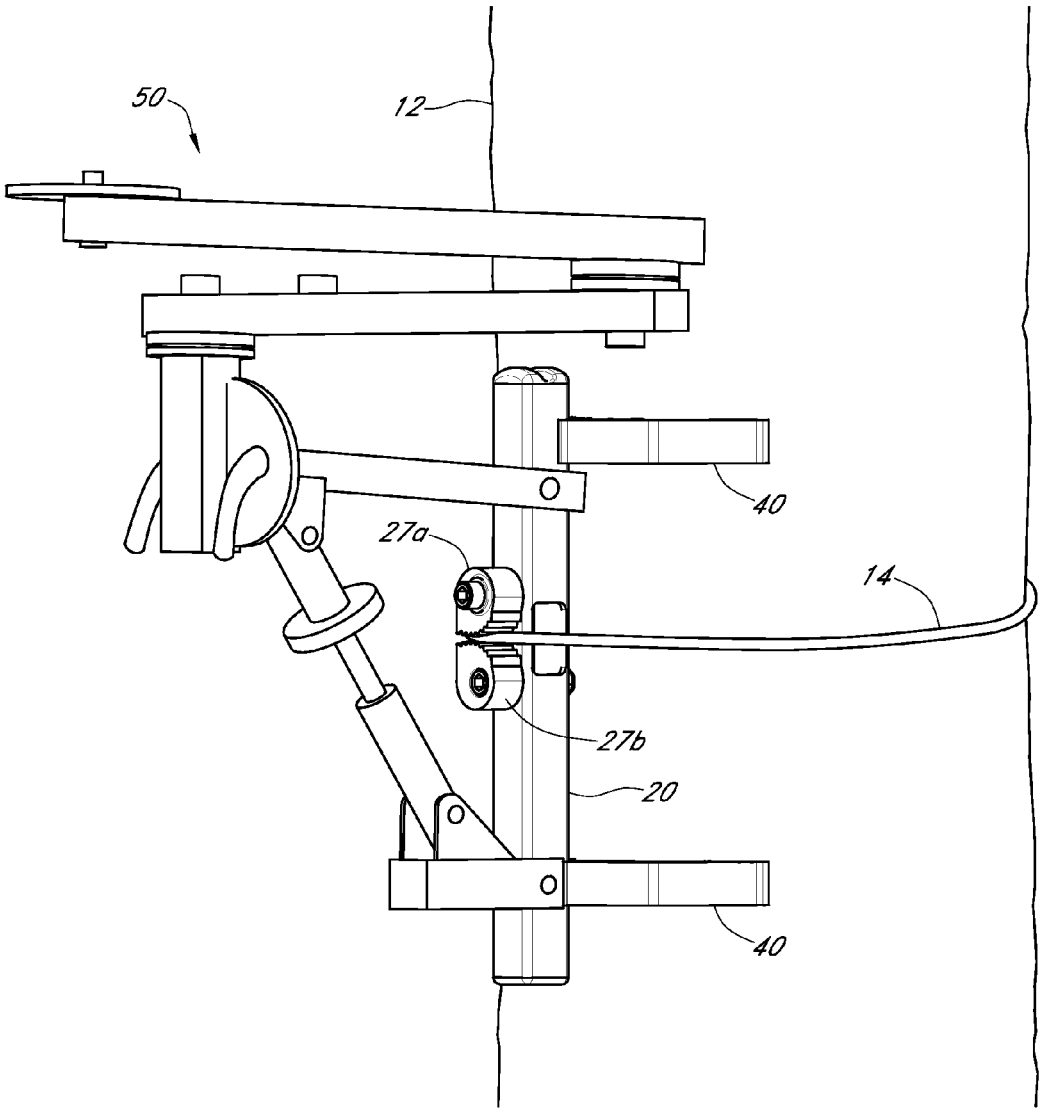
FIG. 10 provides a detailed perspective view of a cam system engaging a rope attached to one embodiment of a camera arm.

The cams 27*a*, 27*b* may be used as a securement system to secure other objects to generally cylindrically shaped, vertically oriented structures, such as trees 12. For example, the cams 27*a*, 27*b* may be pivotally mounted to a camera arm 50 or camera arm base 52 and used in the same manner as described for the ladder module 10 with a flexible member 14 to attach the camera arm 50 to a tree. The present securement system is shown in FIG. 10 as used in securing a camera arm 50 to a tree 12. A securement system as disclosed herein using the cams 27*a*, 27*b* and a flexible member 14 allow the user to secure an object to a tree or other similar structure without the use of metal buckles or clips, which reduces the amount of noise the user makes while securing the object.

Figure 11:
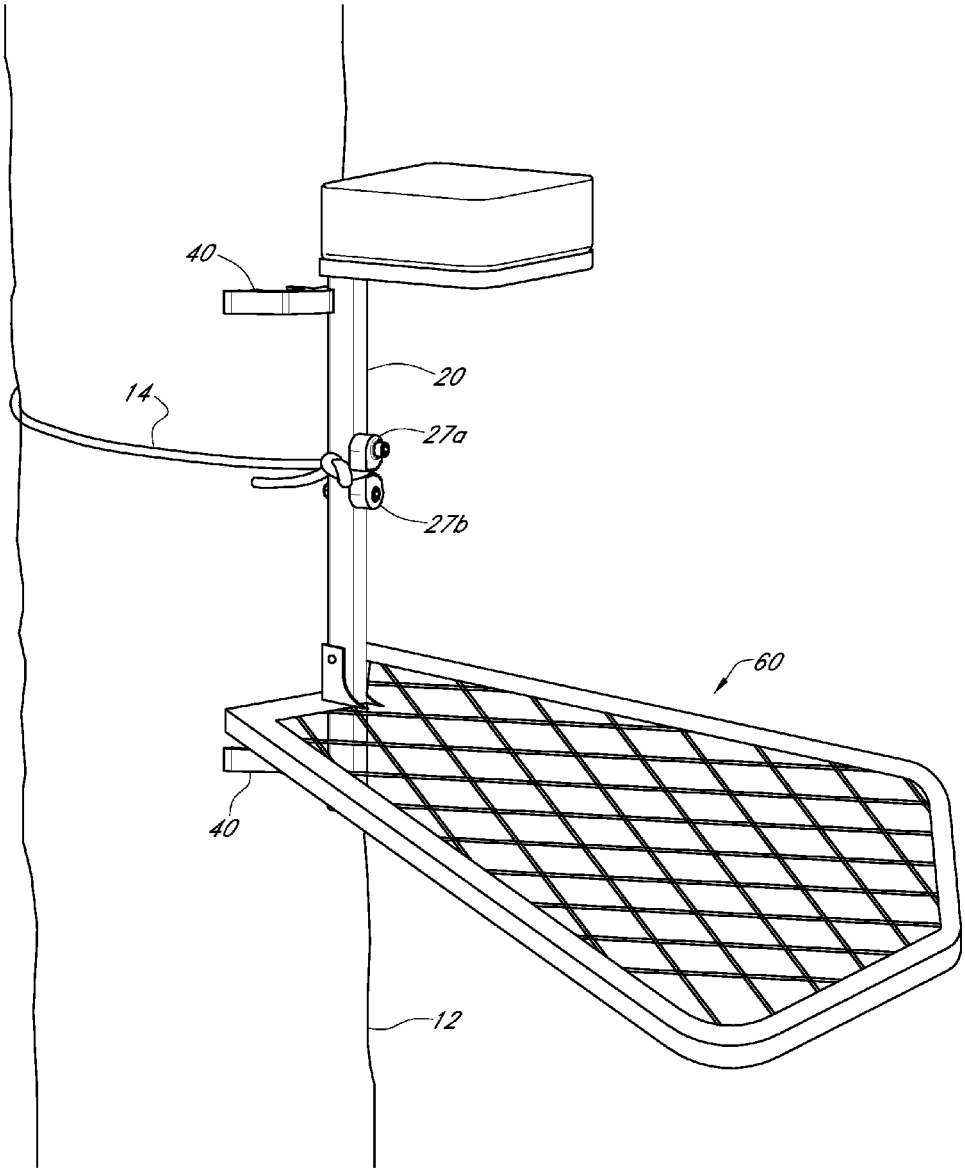
FIG. 11 provides a detailed perspective view of a cam system engaging a rope attached to one embodiment of a tree stand.

Furthermore, a securement system comprised of the cams 27*a*, 27*b* as disclosed herein may be pivotally mounted to a tree stand 60 to mount the tree stand 60 to a tree 12, as best shown in FIG. 11. The number of cams 27*a*, 27*b* and/or flexible members used in the securement system to attach an object to a tree or similar structure is in no way limiting to the scope of the ladder module 10 or securement system as disclosed and claimed herein. It is contemplated that some tree stands 60 and/or ladder modules will be equipped with four cams 27*a*, 27*b*, arranged in pairs of two with one flexible member 14 per pair, or with six cams 27*a*, 27*b* arranged in pairs of two. Accordingly, the specific number of cams 27*a*, 27*b* and/or flexible members 14 that are used to secure an object to a generally vertically oriented, generally cylindrically shaped structure in no way limits the scope of the ladder module 10 or securement system. Furthermore, the object to which the cams 27*a*, 27*b* are attached in no way limits the scope of the securement system as disclosed and claimed herein. The cams 27*a*, 27*b* and resulting securement system may be used to attach any item, including but not limited to tree stands 60, camera arms 50, ladder modules 12, etc., to a generally cylindrically shaped, vertically oriented structure. Furthermore, the securement system as claimed herein may be used with any accessory, item, or accessory strap, and may be used with any suitable flexible member 14.

Other methods of using the ladder module 10 and securement system and embodiments thereof will become apparent to those skilled in the art in light of the present disclosure. Accordingly, the methods and embodiments pictured and described herein are for exemplary purposes only. The ladder module 10 may also be mounted to structures other than trees 12, and therefore the specific structure to which the ladder module 10 is mounted is in no way limits the scope of the ladder module 10 and/or securement system.

The ladder module 10 and various elements thereof may be constructed of any suitable material known to those skilled in the art. In the first embodiment as pictured herein, the spine 20, steps 30, step mounting bracket base 36*a*, step mounting bracket top 36*b*, step mounting bracket bolt 37, and tree bracket 40 are constructed of iron, aluminum, an aluminum alloy, a metal alloy, polymer, or combinations thereof. However, other embodiments may be constructed of other materials, such as cellulosic materials, metallic-plastic combinations, etc., or any combination thereof. Furthermore, the various elements listed above may be cast, molded, extruded, or fabricated by any other manner known to those skilled in the art that is appropriate for the specific materials of construction used. The materials of construction for the flexible member 14 may be any material known to those skilled in the art that is appropriate for the specific application, such as nylon, natural fibers, other polymers, other natural materials, etc., or any combination thereof.

It should be noted that the ladder module 10 and/or securement system is not limited to the specific embodiments pictured and described herein, but is intended to apply to all similar apparatuses and methods for a ladder module 10 and/or securing a ladder module 10 or other structure on a generally cylindrical, vertically oriented structure. Modifications and alterations from the described embodiments will occur to those skilled in the art without departure from the spirit and scope of the ladder module 10 and securement system.

The invention claimed is:

1. A ladder module comprising:

a. a spine;

b. a securement structure secured to said spine;

c. a flexible member affixed to said spine, wherein said flexible member is configured to be engaged with said securement structure;

d. a step mounting bracket base secured to said spine;

e. a step mounting bracket bolt secured to said step mounting bracket base, wherein said step mounting bracket bolt passes through an aperture formed in said spine;

f. a tree bracket secured to said spine, wherein said step mounting bracket bolt passes through an aperture formed in said tree bracket, and wherein said tree bracket includes a plurality of tree engagement members;

g. a nut, wherein said nut engages said step mounting bracket bolt;

h. a first step, wherein said first step is pivotally mounted to said step mounting bracket base, and wherein said first step comprises:

i. a step gear;

ii. a step tread; and iii. a step limit adjacent said step gear;

i. a second step, wherein said second step is pivotally mounted to said step mounting bracket base adjacent said first step, and wherein said second step comprises:

i. a step gear, wherein said step gear of said first step directly contacts and intermeshes with said step gear of said second step such that pivoting said first step with respect to said spine causes said second step to pivot a corresponding amount in the opposite direction and vice versa;

ii. a step tread; and iii. a step limit adjacent said step gear, wherein said step limit of said first step and said step limit of said second step cooperate to limit the amount said first and said second steps rotate with respect to said spine.

2. The ladder module according to claim 1 wherein said securement structure is further defined as a plurality of cams pivotally affixed to said spine.

3. The ladder module according to claim 2 wherein said flexible member is further defined as a rope.

4. The ladder module according to claim 3 wherein said plurality of cams is further defined as a top cam and a bottom cam, wherein at least one of said top and bottom cams is biased towards the other cam.

5. The ladder module according to claim 4 wherein both said top and bottom cams are fashioned with a plurality of cleats on the opposing surfaces of said top and bottom cams.

6. The ladder module according to claim 1 wherein said securement structure is further defined as a buckle.

7. The ladder module according to claim 1 wherein said ladder module further comprises:

a. a step mounting bracket top, wherein said step mounting bracket top is positioned adjacent said first and second steps opposite said step mounting bracket base, and wherein said step mounting bracket top is fashioned as two apertures;

b. a first bolt, wherein said first bolt passes through a first aperture formed in said step mounting bracket top, an aperture formed in said first step, and a first aperture formed in said step mounting bracket base;

c. a second bolt, wherein said second bolt passes through a second aperture formed in said step mounting bracket top, and aperture formed in said second step, and a second aperture formed in said step mounting bracket base; and d. a first and second nut, wherein said first nut engages said first bolt and wherein said second nut engages said second bolt.

8. The ladder module according to claim 7 further comprising a plurality of washers, wherein a first washer is positioned between said first step and said step mounting bracket base, a second washer is positioned between said second step and said step mounting bracket base, a third washer is positioned between said first step and said step mounting bracket top, and a fourth washer is positioned between said second step and said step mounting bracket top.

9. The ladder module according to claim 7 further comprising:

a. a second step mounting bracket base secured to said spine;

b. a second step mounting bracket bolt secured to said second step mounting bracket base, wherein said second step mounting bracket bolt passes through a second aperture formed in said spine;

c. a second tree bracket secured to said spine, wherein said second step mounting bracket bolt passes through an aperture formed in said second tree bracket, and wherein said second tree bracket includes a plurality of tree engagement members;

d. a nut, wherein said nut engages said second step mounting bracket bolt;

e. a third step, wherein said third step is pivotally mounted to said second step mounting bracket base, and wherein said third step comprises:

i. a step gear;

ii. a step tread; and iii. a step limit adjacent said step gear;

f. a fourth step, wherein said fourth step is pivotally mounted to said second step mounting bracket base adjacent said third step, and wherein said fourth step comprises:

i. a step gear, wherein said step gear of said third step directly contacts and intermeshes with said step gear of said fourth step such that pivoting said third step with respect to said spine causes said fourth step to pivot a corresponding amount in the opposite direction and vice versa;

ii. a step tread; and iii. a step limit adjacent said step gear, wherein said step limit of said third step and said step limit of said fourth step cooperate to limit the amount said third and said fourth steps rotate with respect to said spine.

10. The ladder module according to claim 9 further comprising a plurality of washers, wherein a fifth washer is positioned between said third step and said second step mounting bracket base, a sixth washer is positioned between said fourth step and said second step mounting bracket base, a seventh washer is positioned between said third step and said second step mounting bracket top, and a eighth washer is positioned between said fourth step and said second step mounting bracket top.

11. The ladder module according to claim 10 wherein said ladder module is configured to allow a plurality of ladder modules nest with one another so that said plurality of ladder modules occupies a minimal volume when nested.

12. The ladder module according to claim 10 wherein said tree bracket and said second tree bracket are further defined as including a spine pocket therein.

13. The ladder module according to claim 9 further comprising:

a. a third step mounting bracket base secured to said spine;

b. a third step mounting bracket bolt secured to said second step mounting bracket base, wherein said third step mounting bracket bolt passes through a third aperture formed in said spine;

c. a third tree bracket secured to said spine, wherein said third step mounting bracket bolt passes through an aperture formed in said third tree bracket, and wherein said third tree bracket includes a plurality of tree engagement members;

d. a nut, wherein said nut engages said third step mounting bracket bolt;

e. a fifth step, wherein said fifth step is pivotally mounted to said third step mounting bracket base, and wherein said fifth step comprises:

i. a step gear;

ii. a step tread; and iii. a step limit adjacent said step gear;

f. a sixth step, wherein said sixth step is pivotally mounted to said third step mounting bracket base adjacent said fifth step, and wherein said sixth step comprises:

i. a step gear, wherein said step gear of said sixth step directly contacts and intermeshes with said step gear of said fifth step such that pivoting said fifth step with respect to said spine causes said sixth step to pivot a corresponding amount in the opposite direction and vice versa;

ii. a step tread; and iii. a step limit adjacent said step gear, wherein said step limit of said third step and said step limit of said fourth step cooperate to limit the amount said third and said fourth steps rotate with respect to said spine.

14. A pair of cooperating steps for use with a ladder module, wherein said pair of cooperating steps comprises:

a. a first step, wherein said first step is pivotally mounted to said ladder module, and wherein said first step comprises:
   i. a step gear;
   ii. a step tread; and
   iii. a step limit adjacent said step gear;

b. a second step, wherein said second step is pivotally mounted to said ladder module adjacent said first step, and wherein said second step comprises:
   i. a step gear, wherein said step gear of said first step directly contacts and intermeshes with said step gear of said second step such that pivoting said first step about said ladder module causes said second step to pivot a corresponding amount in the opposite direction and vice versa;
   ii. a step tread; and
   iii. a step limit adjacent said step gear, wherein said step limit of said first step and said step limit of said second step cooperate to limit the amount said first and said second steps rotate about said ladder module.

15. A ladder module comprising:

a. a spine;

b. a securement structure secured to said spine;

c. a flexible member affixed to said spine, wherein said flexible member is configured to be engaged with said securement structure;

d. a step mounting bracket base secured to said spine;

e. a step mounting bracket bolt secured to said step mounting bracket base, wherein said step mounting bracket bolt passes through an aperture formed in said spine;

f. a tree bracket secured to said spine, wherein said step mounting bracket bolt passes through an aperture formed in said tree bracket, and wherein said tree bracket includes a plurality of tree engagement members;

g. a nut, wherein said nut engages said step mounting bracket bolt;

h. a first step, wherein said first step is pivotally mounted to said step mounting bracket base, and wherein said first step comprises:
   i. a step gear;
   ii. a step tread; and
   iii. a step limit adjacent said step gear;

i. a second step, wherein said second step is pivotally mounted to said step mounting bracket base adjacent said first step, and wherein said second step comprises:
   i. a step gear, wherein said step gear of said first step directly contacts and intermeshes with said step gear of said second step such that pivoting said first step with respect to said spine causes said second step to pivot a corresponding amount in the opposite direction and vice versa;
   ii. a step tread; and
   iii. a step limit adjacent said step gear, wherein said step limit of said first step and said step limit of said second step cooperate to limit the amount said first and said second steps rotate with respect to said spine;

j. a top cam pivotally mounted to said spine, wherein said top cam includes a plurality of cleats on a bottom surface, wherein a periphery of said bottom surface is generally curved, and wherein a portion of the periphery of said top cam is generally flat adjacent said bottom surface;

k. a bottom cam pivotally mounted to said spine, wherein said bottom cam includes a plurality of cleats on its top surface, wherein the distance between the respective axes of rotation of said top cam and said bottom cam is between 0.15 and 6 inches, wherein the periphery of said top surface is generally curved, and wherein a portion of the periphery of said bottom cam is generally flat adjacent said top surface;

l. a flexible member, wherein a first end of said flexible member is configured to be secured to said spine, and wherein said flexible member is configured to be engaged with said top and bottom cam such that when said flexible member is positioned between said top and bottom cam and said portion of the periphery of said top cam and said portion of the periphery of said bottom cam are parallel with respect to one another, said top cam and said bottom cam pinch said flexible member such that said top and bottom cams cannot counter rotate past one another; and m. at least one step pivotally engaged with said spine.

16. The ladder module according to claim 15 wherein said top cam is biased for rotation in a direction that would cause said plurality of cleats on said top cam to engage said plurality of cleats on said bottom cam.

17. The ladder module according to claim 16 wherein said bottom cam is biased for rotation in a direction that would cause said plurality of cleats on said bottom cam to engage said plurality of cleats on said top cam.

* * * * *